United States Patent [19]

Ciulli

[11] Patent Number: 4,852,835

[45] Date of Patent: Aug. 1, 1989

[54] PORTABLE TABLE HAVING A SINGLE SUPPORTING LEG TO BE ANCHORED TO THE GROUND AND A TILTABLE TOP PANEL

[76] Inventor: Paolo Ciulli, Via Pontaccio, 19, 20121 Milano, Italy

[21] Appl. No.: 206,473

[22] Filed: Jun. 13, 1988

[30] Foreign Application Priority Data

Jun. 15, 1987 [IT] Italy ..... 20904 A/87

[51] Int. Cl.[4] ..... A45F 3/44

[52] U.S. Cl. ..... 248/156; 108/115

[58] Field of Search ..... 248/156, 545; 108/158, 108/159, 150, 6, 7, 8, 28, 117, 27, 115; 126/29; 4/627

[56] References Cited

U.S. PATENT DOCUMENTS

| | | | |
|---|---|---|---|
| 896,384 | 8/1908 | Hohnsbeen | 248/156 X |
| 1,218,357 | 3/1917 | Bauer | 108/158 |
| 2,603,440 | 7/1952 | Vesconte | 108/28 X |
| 3,283,733 | 11/1966 | Boerma | 108/159 |
| 4,407,475 | 10/1983 | Gossage | 108/5 |
| 4,497,077 | 2/1985 | Provost | 4/627 |

FOREIGN PATENT DOCUMENTS

| | | | |
|---|---|---|---|
| 482611 | 4/1952 | Canada | 248/156 |
| 1481285 | 5/1967 | France | 248/156 |
| 212617 | 3/1941 | Switzerland | 248/156 |

*Primary Examiner*—J. Franklin Foss

*Attorney, Agent, or Firm*—Bucknam and Archer

[57] ABSTRACT

A portable table comprises a ring member mounted, at a perimetrical portion thereof, on a pointed rigid rod which radially extends with respect to the ring, the ring supporting on a diametrical axis perpendicular to the rod a disc member which can be restrained in a horizontal position for providing a supporting surface.

3 Claims, 2 Drawing Sheets

PORTABLE TABLE HAVING A SINGLE SUPPORTING LEG TO BE ANCHORED TO THE GROUND AND A TILTABLE TOP PANEL

BACKGROUND OF THE INVENTION

The present invention relates to a portable table structure provided with a single supporting leg to be anchored in the ground and with a tiltable top panel.

As is known reduced size tables are frequently used for supporting glasses and foods for use by one or two persons, for example in gardens, fields and the like.

This small tables have usually a foldable construction and comprise several legs articulated to a top panel: these legs, however, are rather difficult to be folded and straightened, in order to store the table for transportation and prepare it for use.

Moreover known portable tables are rather complex construction-wise and their operation is not completely reliable.

Thus, the main object of the present invention is to overcome the above mentioned drawbacks by providing a portable table structure which can be quickly and easily arranged in its transportation or stored condition and use condition.

Another object of the present invention is to provide such a portable table which, in its stored condition, has a very reduced size.

Yet another object of the present invention is to provide such a portable table which is very simple construction-wise and which is very reliable in operation.

According to one aspect of the present invention, the above mentioned objects, as well as yet other objects, which will become more apparent hereinafter, are achieved by a portable table characterized in that said portable table essentially comprises a ring member which is mounted, at a perimetrical portion thereof, on a pointed rigid rod which radially extends with respect to said ring member, said ring member supporting, on a diametrical axis perpendicular to said rod, a disc element adapted to be restrained in a horizontal position to provide a supporting surface.

BRIEF DESCRIPTION OF THE DRAWINGS

Further characteristics and advantages of the portable table according to the present invention will become more apparent hereinafter from the following detailed description of a preferred embodiment thereof, which is illustrated, by way of an indicative example, in the figures of the accompanying drawings, where.

DESCRIPTION OF THE PREFERRED EMBODIMENTS

Figure 1:
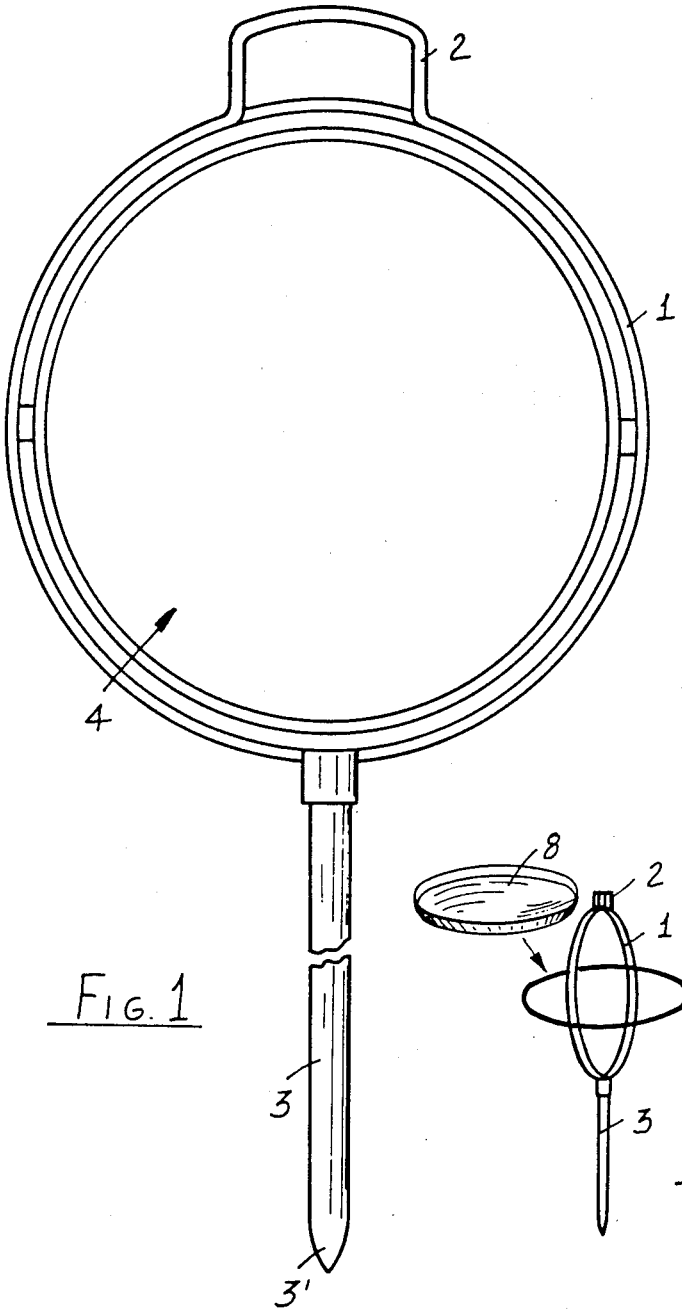
FIG. 1 illustrates the portable table according to the present invention, with the table top panel arranged in the same plane as the ring member supporting it.

With reference to the figures of the accompanying drawings, the portable table according to the present invention, essentially comprises a ring member 1, preferably of circular shape, and provided with a perimetrical projecting lug 2 adapted to operate as a handle.

This ring member, as shown, is mounted, at its perimetrical portion opposite to said projecting lug, on a rigid rod 3 having a given length and including a pointed end portion 3'.

Said rigid rod, in particular, is radially extended with respect to the ring member 1 and lies in the same plane as said ring member.

On the ring member there is pivoted, on a diametrical axis perpendicular to said rod 3, a tiltable panel, indicated overally at the reference number 4, which can be arranged in a stable horizontal position (by means of known restraining member) and which is adapted to operate as a supporting surface for glasses 5, sandwiches 6 and the like.

Figure 2:
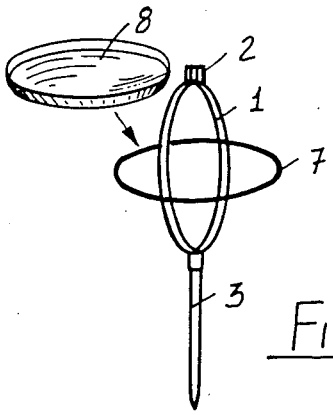
FIG. 2 shows another configuration of the tiltable panel.
Figure 3:
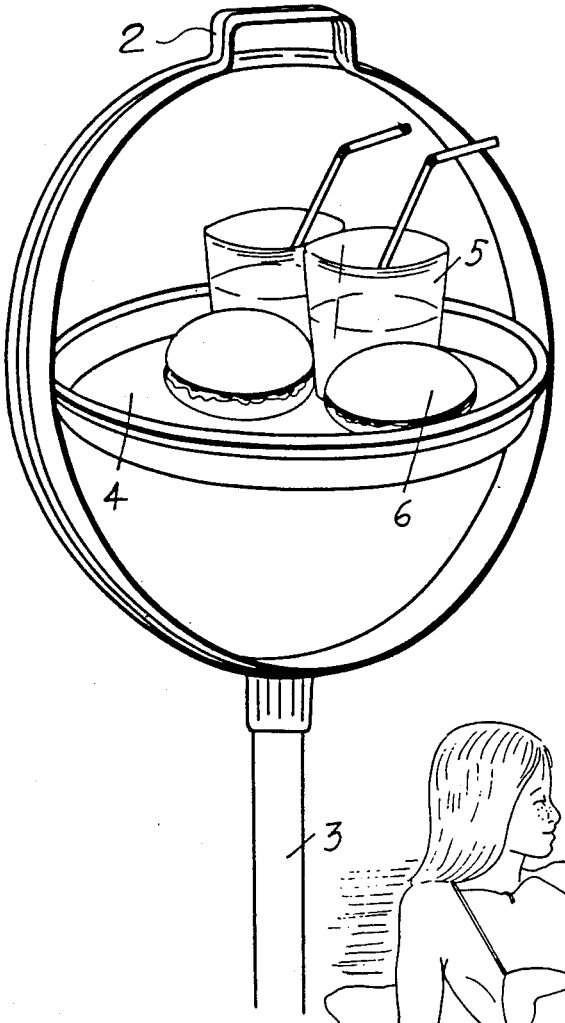
FIGS. 3 and 4 show typical uses of the subject portable table.
Figure 4:
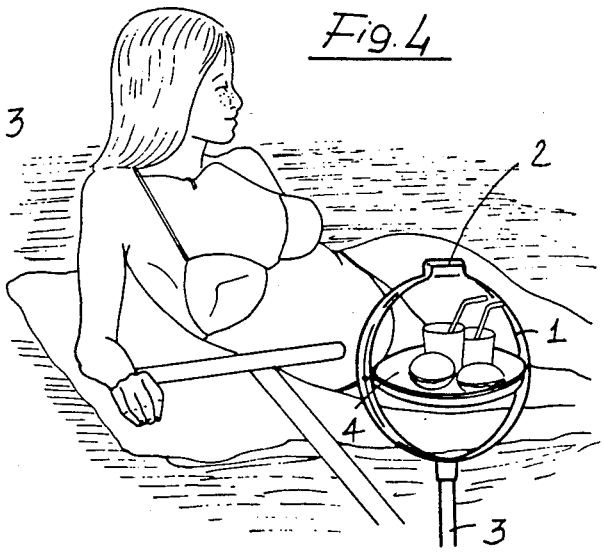

In this condition it should be pointed out that the mentioned tiltable panel can also consist (as shown in FIG. 2) of a second ring member 7 which is pivoted to the ring member 1, and thereon there is removably arranged a tray 8.

For erecting the table, the rigid rod 3 must be introduced into the ground and the panel 4 must be brought to its horizontal attitude.

From the above disclosure it should be apparent that the invention fully achieves the intended objects.

While the invention has been disclosed and illustrated with reference to a preferred embodiment thereof, it should be apparent that this embodiment is susceptible to many modifications and variations.

I claim:

1. A portable table comprising a first ring member mounted, at a perimetrical portion thereof, on a pointed rigid rod radially extending with respect to said first member and lying in the same plane as said first ring member, said first ring member supporting, on a diametrical axis perpendicular to said rod, a circular closed loop element which can be brought to and restrained in a horizontal position to operate as a supporting surface, said first ring member having a circular shape and being provided with a perimetrical projecting lug operating as a handle.

2. A portable table according to claim 1, wherein said circular closed loop element consists of a second ring member articulated to said first ring member and thereon a tray is removably supported.

3. A portable table according to claim 1, wherein said circular closed loop element consists of a solid panel member articulated to said first ring member.

* * * * *